US006252355B1

(12) United States Patent
Meldrum et al.

(10) Patent No.: US 6,252,355 B1
(45) **Date of Patent: *Jun. 26, 2001**

(54) METHODS AND APPARATUS FOR CONTROLLING THE INTENSITY AND/OR EFFICIENCY OF A FLUORESCENT LAMP

(75) Inventors: Richard Mitchel Meldrum, Glendale; Bruce Anthony Pitman, Phoenix, both of AZ (US)

(73) Assignee: Honeywell International Inc., Morristown, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/224,593

(22) Filed: Dec. 31, 1998

(51) Int. Cl.[7] ..... H05B 37/02; H05B 31/24

(52) U.S. Cl. ..... 315/150; 315/151; 315/112; 315/224

(58) Field of Search ..... 315/307, 224, 315/308, 149, 150, 158, 112, 115, 117, 118, 151, 94

(56) References Cited

U.S. PATENT DOCUMENTS

| | | | |
|---|---|---|---|
| 2,961,564 | 11/1960 | Kenty | 313/174 |
| 4,005,332 | 1/1977 | Gallo et al. | 315/112 |
| 4,070,570 | 1/1978 | Wetmore et al. | 362/218 |
| 4,518,895 | 5/1985 | Lehman | 315/117 |
| 4,529,912 | 7/1985 | Northrup et al. | 315/117 |
| 4,533,853 | 8/1985 | Hammond et al. | 315/117 |
| 4,533,854 | 8/1985 | Northrup | 315/117 |
| 4,694,215 | 9/1987 | Hofmann | 313/44 |
| 5,274,305 | 12/1993 | Bouchard | 315/108 |
| 5,416,385 * | 5/1995 | Hau | 315/151 |
| 5,428,265 * | 6/1995 | Booth, Jr. et al. | 315/150 |
| 5,581,157 | 12/1996 | Vrionis | 315/117 |
| 5,612,593 * | 3/1997 | Olson | 315/117 |
| 5,646,702 | 7/1997 | Akinwande et al. | 349/69 |
| 5,659,227 * | 8/1997 | Ushiro et al. | 315/360 |
| 5,754,013 * | 5/1998 | Praiswater | 315/307 |
| 5,773,926 | 6/1998 | Maya et al. | 313/490 |
| 5,808,418 | 9/1998 | Pitman et al. | 315/115 |
| 5,841,246 * | 11/1998 | Manders | 315/307 |
| 5,909,085 * | 6/1999 | Nelson | 315/118 |
| 5,990,627 * | 11/1999 | Chen et al. | 315/117 |

FOREIGN PATENT DOCUMENTS 58016538 8/1984 (JP) .

* cited by examiner

*Primary Examiner*—David Vu
*Assistant Examiner*—Wilson Lee

(57) ABSTRACT

Methods and apparatus for controlling the brightness level of a lamp in a backlit LCD display include primary and secondary controllers. The primary controller establishes the arc drive to the lamp to achieve the desired lamp brightness. The primary controller includes a desired brightness setpoint as a first input, and a feedback signal corresponding to actual brightness detected at the lamp as a second input. The primary controller operates in real time, essentially adjusting the lamp arc drive instantaneously as a function of the detected brightness feedback signal. The secondary controller is employed to fine tune the control of the lamp by determining whether the desired brightness level may be achieved more efficiently. The secondary controller varies one or more parameters, such as temperature, within the lamp to achieve the optimum operating point of the lamp at the desired brightness level.

20 Claims, 7 Drawing Sheets

METHODS AND APPARATUS FOR CONTROLLING THE INTENSITY AND/OR EFFICIENCY OF A FLUORESCENT LAMP

BACKGROUND OF THE INVENTION

1. Technical Field

The present invention relates, generally, to a control system for maintaining optimum efficiency of a backlight and, more particularly in a preferred embodiment, to a closed loop temperature controller for adjusting the temperature within a fluorescent lamp to thereby optimize lamp arc drive for a given predetermined brightness set point.

2. Background Art and Technical Problems

Screen displays which employ fluorescent lamp backlights are used extensively in commercial, military, and consumer electronic applications. For example, such backlights are commonly used in desktop computers, laptop computers, screen displays for industrial equipment, and in connection with "heads up" or other screen displays in the cockpits in both commercial and military aircraft.

Conventional fluorescent lamps are commonly employed in backlit Liquid Crystal Display (LCD) applications. In a typical LCD, alphanumeric characters and other graphical images are produced on the viewing screen by selectively energizing or de-energizing preselected pixels in a two dimensional matrix to display the information. In a normally black screen display, predetermined pixels are illuminated to display the data or information as illuminated characters on a black (or other dark shade) background. In a normally white display, on the other hand, the desired data and/or information corresponds to the non-illuminated pixels, such that the information appears as black (or other dark color) images on a white (or other light color) background. In either case, a bright, consistent "background" light is necessary to achieve desirable contrast on the flat screen display. Indeed, in certain applications (e.g., military avionics), the high contrast provided by a bright backlight is essential to proper operation of the display.

It is also desirable to obtain a desired brightness while minimizing power consumption. This is particularly important in portable electronics, for example laptop computers and the like, where battery life is an important product feature.

Presently known systems for controlling the brightness of a fluorescent backlight lamp typically involve a control system for supplying lamp arc drive to the backlight, to thereby excite the gas atoms within the sealed lamp enclosure to create visible light. The amount of visible light emitted by the lamp is sensed, for example by a photodiode, and a feedback signal indicative of the brightness output of the lamp is fed back to a control circuit. This feedback signal (indicative of actual brightness) is compared to an input signal representative of a desired brightness level, and presently known control systems drive the difference between this actual signal and the desired signal to a minimum. Under this control regime, if the actual brightness is less than the desired brightness, the controller increases the lamp arc drive applied to the lamp until the actual brightness equals the desired brightness. If, on the other hand, the actual brightness is greater than the desired brightness, the controller circuit reduces the magnitude of the lamp arc drive applied to the lamp until the actual brightness emitted from the lamp again equals the desired brightness level for the lamp. Presently known prior art brightness control systems typically employ a "cold spot" at a predetermined point on the lamp which functions to keep a certain amount of the gas (typically mercury) within the lamp in a condensed state. Such "cold spot" systems employ the well known principle that maintaining the temperature of the cold spot in a specified range allows for very efficient operation of the lamp. Presently known systems, however, often require expensive components to maintain the cold spot, and do not adequately compensate for drifting or degradation over time of some of the parameters which influence the efficiency of the lamp.

A fluorescent lamp control system is thus needed which overcomes the shortcomings of the prior art.

SUMMARY OF THE INVENTION

The present invention provides improved methods and apparatus for optimizing the operating efficiency of a fluorescent lamp. In accordance with a preferred embodiment of the present invention, a primary control system controls the lamp arc drive to the lamp. The primary control system includes a desired brightness set-point as a first input, and a feedback signal corresponding to actual brightness detected at the lamp as a second input. The primary controller is configured to drive the difference between the aforementioned first and second inputs to a minimum: that is, to the extent the actual (detected) brightness of the lamp is greater than the desired "set-point" brightness, the primary controller reduces the lamp arc drive applied to the lamp until the actual brightness exhibited by the lamp is equal to the desired set-point brightness. Conversely, to the extent the actual brightness of the lamp is less than the desired set-point brightness, the primary controller increases the lamp arc drive signal until the actual brightness exhibited by the lamp equals the desired set-point level. In accordance with one aspect of the present invention, the primary controller operates in real time, essentially adjusting the lamp arc drive instantaneously as a function of the detected brightness feedback signal.

In accordance with a further aspect of the present invention, a secondary controller is employed to fine tune the control of the lamp by determining whether the desired brightness level may be achieved more efficiently. In accordance with a preferred embodiment, the secondary controller has a slower response time than the primary controller, and is configured to vary one or more parameters associated with the lamp to maintain the desired output level in an optimally efficient manner by adjusting one or more of the following: lamp arc drive, lamp temperature, lamp pressure, lamp volume, the quantity of gas within the lamp, or any other parameter which may effect the relative proportion of gas within the lamp in the vapor phase compared to the condensed phase or the efficiency with which the lamp produces a desired brightness output level.

In accordance with a preferred embodiment of the present invention, when the primary controller achieves an output brightness which is equal to the desired set-point brightness level, the primary controller outputs a constant lamp arc drive signal to the lamp. During this period in which a constant arc drive is applied to the lamp, the secondary controller varies a control parameter (e.g., temperature) associated with the gas within the lamp to determine whether a change in the control parameter (either upwardly or downwardly) causes a corresponding increase (or decrease) in lamp brightness. If lamp brightness decreases in response to varying the control parameter, the secondary controller may be configured to either reverse the change in the control parameter which caused the decrease in lamp brightness, or alternatively, the secondary controller may be configured to simply stop varying the control parameter in the direction which caused the decrease in lamp brightness.

If, on the other hand, the lamp brightness increases as a result of the secondary controller varying the control parameter, the secondary controller may be configured to continue to adjust the control parameter in the direction which caused an increase in the lamp output brightness until the lamp output brightness is maximized. Preferably, the parameter monitored and controlled by the secondary controller is the lamp temperature. This is achieved, for example, by monitoring and controllably varying the voltage and/or current through a resistive wire coupled to the lamp surface.

In accordance with the further aspect of the present invention, a desired lamp brightness output level may be achieved while driving the lamp arc drive required to obtain the desired lamp brightness to a minimum. Thus, the desired lamp brightness may be achieved while reducing the power required to achieve the desired brightness level. Such a reduction in total power required to operate the lamp at a desired brightness level may result in extended battery life for portable screen displays or other displays in which it is desired to conserve power; for example, in military and commercial avionics applications.

In accordance with yet a further aspect of the present invention, the use of a secondary controller permits more efficient operation of the lamp, resulting in reduced degradation of the lamp, and in particular the thin phosphorous layer on the surface of the lamp, thereby extending lamp life.

BRIEF DESCRIPTION OF THE DRAWING FIGURES

The subject invention will hereinafter be described in conjunction with the appended drawing figures, wherein like numerals denote like elements, and:

DETAILED DESCRIPTION OF PREFERRED EXEMPLARY EMBODIMENTS

Figure 1:
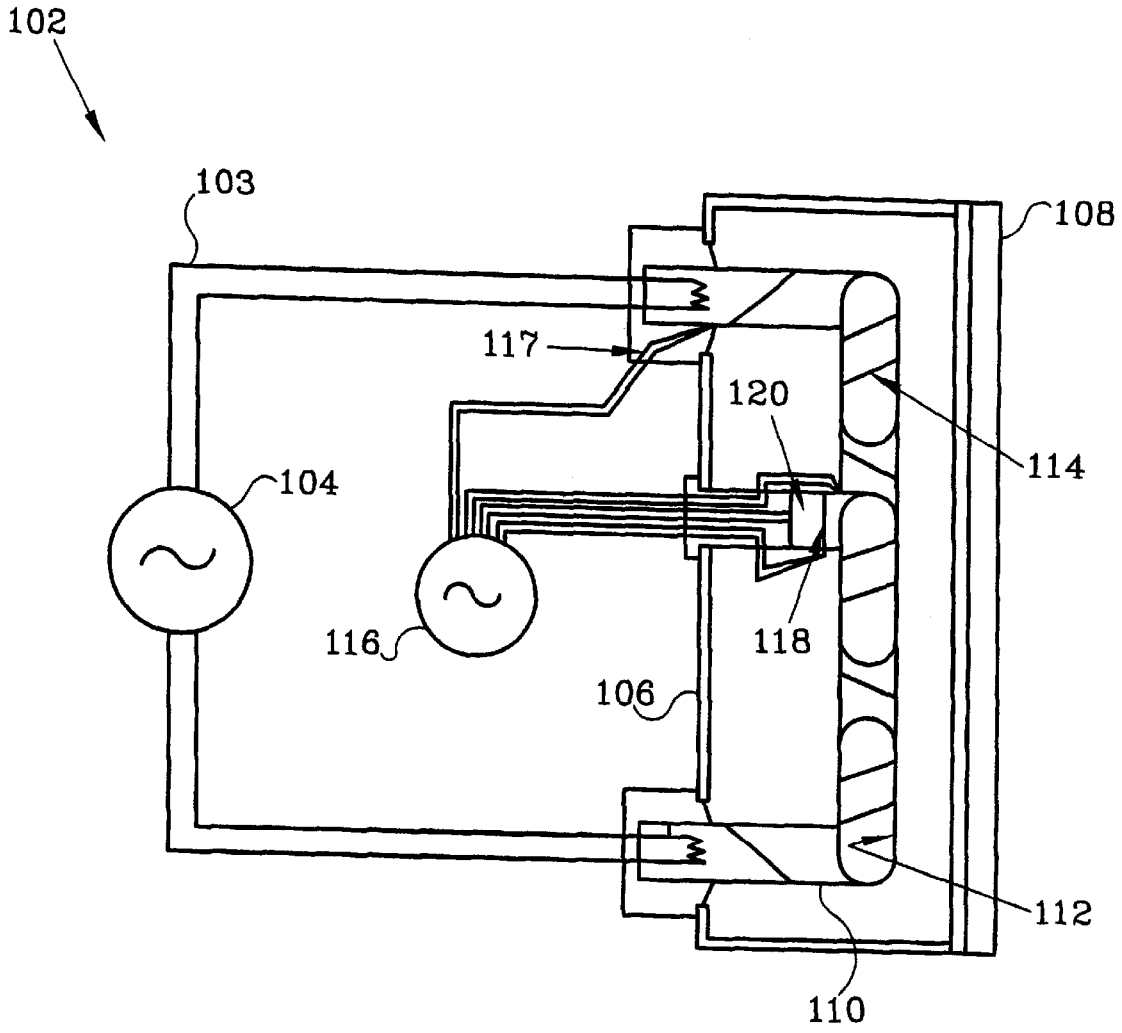
Fig.1 Prior Art
FIG. 1 is a schematic diagram of a prior art screen display including a fluorescent lamp having a thermo-electric cooler attached thereto for maintaining a cold spot in the lamp.

Referring now to FIG. 1, an exemplary flat screen display system 102 suitably includes a flat screen 108, for example an LCD (shown in side cross-sectional view), illuminated by a backlight 110. The screen display system 102 further includes an AC power supply 104, an AC power conduit 103, a DC power supply 116, and a DC conduit 117 connected to a resistive wire 114 wrapped around lamp 110, with the lamp shown disposed within a lamp housing 106. For a more thorough discussion of prior art backlight systems, see, for example, Pitman et al., U.S. Pat. No. 5,808,418 issued Sep. 15, 1998, the entire contents of which are hereby incorporated here into by this reference.

Those skilled in the art will appreciate that lamp 110 is suitably filled with a quantity of gas, for example mercury, which interacts with a thin film layer of phosphorous 112 suitably coated on the inside walls of lamp 110. During operation of the lamp, an AC voltage is applied to the lamp, for example by AC power conduit 103, which causes an AC current to be driven through the gas. In addition, a resistive wire 114 is suitably wrapped or otherwise disposed about the outer surface of lamp 110, to thereby control the temperature of the lamp. By controlling the temperature of the lamp, a desired proportion of the total gas within the lamp may be maintained in the vapor phase, with a corresponding quantity of the gas within the lamp being maintained in the condensed phase. Those skilled in the art will appreciate that prior art systems attempted to control the efficiency of the lamp by maintaining the lamp at a predetermined optimum temperature.

With continued reference to FIG. 1, in order to maintain an optimum temperature within the lamp, a cold shoe, for example a copper cold shoe 118, was employed in conjunction with a thermal-electric cooler 120. The thermal-electric cooler controlled the temperature of cold shoe 118, to thereby maintain a desired cold spot temperature for the lamp. By maintaining the cold spot within a desired range, prior art systems thereby insured reasonably efficient operation of the lamp. However, the use of cold shoes and thermal-electric coolers, as well as the need to employ a thermal-electric cooler control mechanism resulted in bulky, expensive control mechanisms.

Figure 2:
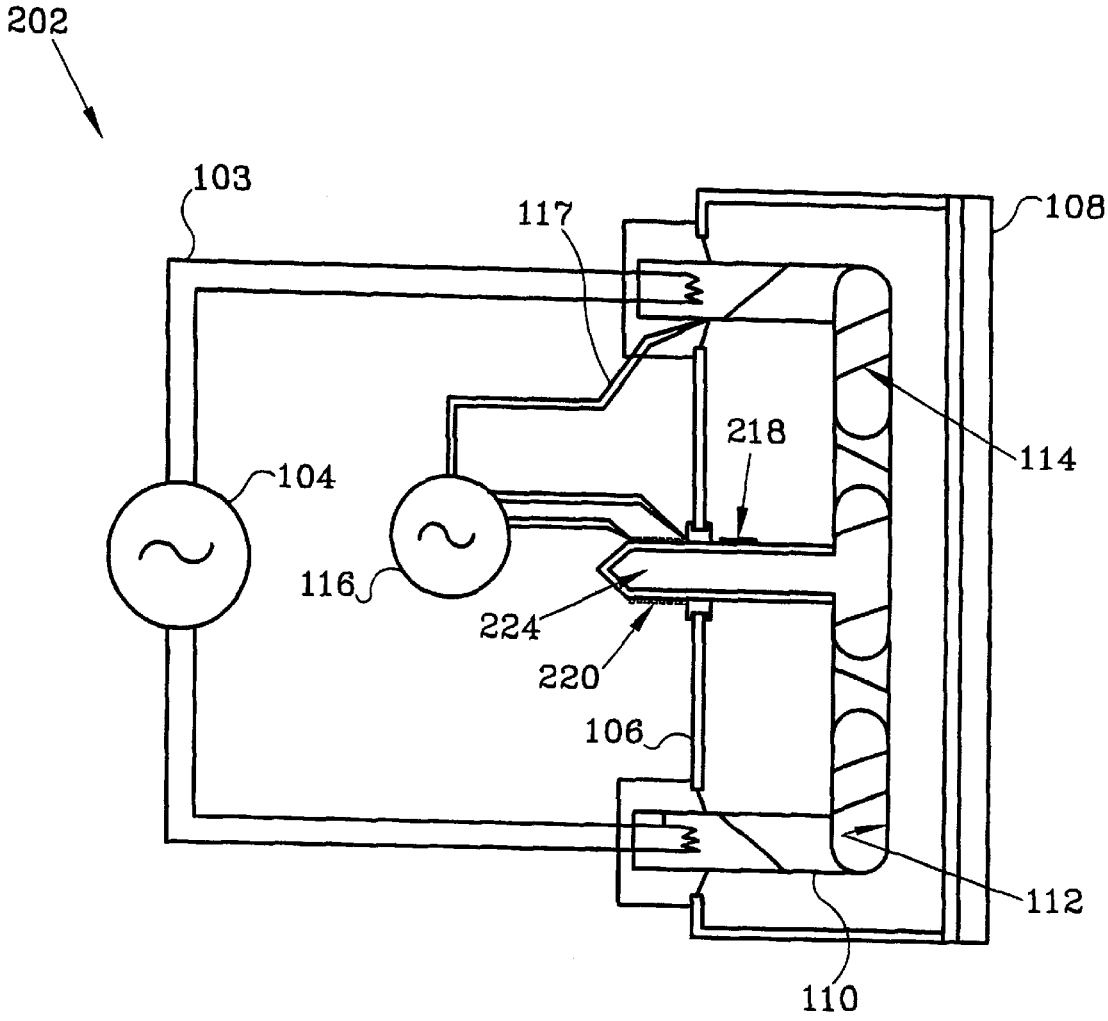
Fig.2 Prior Art
FIG. 2 is a schematic diagram of a prior art screen display including a fluorescent lamp which employs a lamp extension as a mechanism for maintaining a cold spot.

Referring now to FIG. 2, in which a similar flat screen display system 202 is depicted, but for which the aforementioned '418 patent discloses replacing prior art cold shoe and thermal-electric coolers with a lamp extension 218 which includes a portion that extends beyond the back wall and outside of lamp housing 206. By maintaining a portion of the lamp outside of the lamp housing, a natural "cold spot" could be maintained without the need for a thermal-electric cooler. As described in the '418 patent, this allowed the temperature of the cold spot to be controlled with air flow and a simple heater wire 220.

Prior art attempts to control the location and temperature of a cold spot have proved unsatisfactory in several regards. For example, a continued cold spot may be unreliable and unpredictable; indeed, the present inventors have determined that additional cold spots may develop within the lamp during operation which impedes the ability to accurately control the temperature and pressure of the gas within the lamp. Moreover, cold spots can move from place to place within the lamp, and may also be distributed about a large area of the lamp. However, the present inventors have further determined that the existence of one or more cold spots within a lamp need not impede precise control of the relevant lamp gas parameters, as long as the desired brightness may be obtained with a relatively low amount of arc drive.

Figure 3:
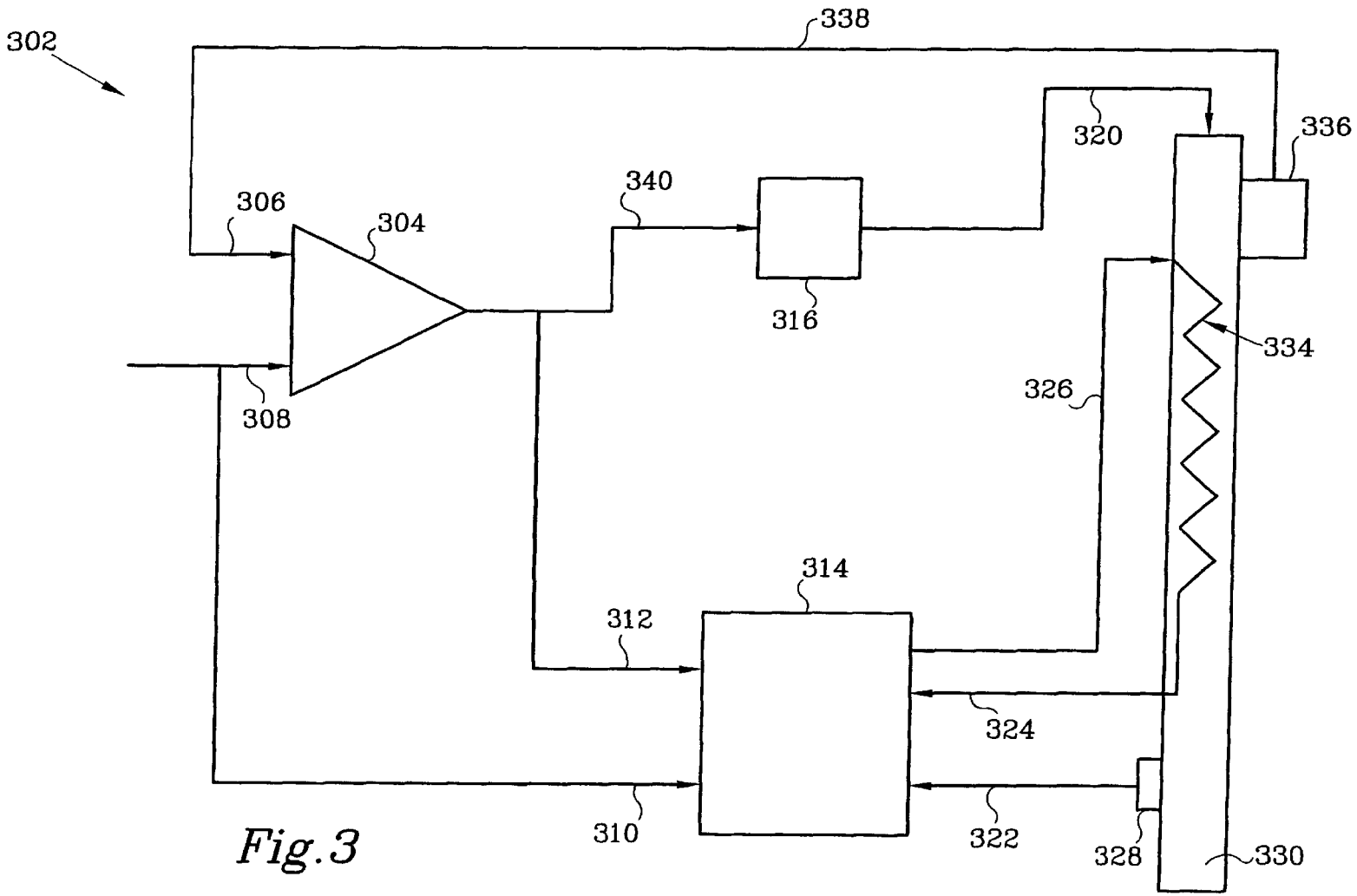
FIG. 3 illustrates schematically in block diagram form a functional circuit illustrating primary and secondary controllers in accordance with one embodiment of the present invention.

Referring now to FIG. 3, in which an exemplary lamp control circuit 302 in accordance with a preferred embodiment of the invention is depicted. Lamp control circuit 302 suitably includes a lamp 330, a lamp heater 334 (e.g., a resistive wire), a sensor or transducer 336 (e.g., a photodiode), a gain stage 316, a first controller 304, and a second controller 314. In the context of this description, first controller 304 is variously referred to herein as controller $C_p$ (or primary controller), whereas second controller 314 is variously referred to herein as controller $C_T$ (or secondary controller).

In accordance with a preferred embodiment to the present invention, a brightness set-point signal $V_{sp}$ is suitably applied to a first input 308 of primary controller 304, and a brightness feedback signal 338 ($V_{fb}$) is suitably applied to a second input 306 of primary controller 304. In a preferred embodiment, feedback signal 338 is suitably indicative of the actual brightness exhibited by the lamp, for example as detected by the sensor or transducer 336 (e.g., photodiode) near the surface of the lamp. It will be appreciated that the desired brightness level, $V_{sp}$, may be varied by the operator of the screen display, for example by a pilot, computer terminal operator, or other user of equipment employing a flat screen display which utilizes lamp control system 302.

Primary controller 304 essentially functions in real-time to maintain an output brightness level from the lamp, as detected by sensor or transducer 336, which is equal to the desired set-point brightness level $V_{sp}$. In this regard, any suitable control scheme may be employed to maintain a desired brightness level, for example, by using a proportional controller, a proportional-integral controller, or a proportional-integral-derivative control scheme.

Primary controller 304 suitably outputs an output control signal 340 (also referred to herein as $V_c$) which is applied to a gain circuit 316, which in turn, produces a lamp arc drive signal 320 (also referred to herein as $V_d$) which is applied to the lamp to excite the gas within the lamp. It will be appreciated that the gain stage may be a part of or integrated into the primary controller 304 (i.e., such that the primary controller 304 supplies sufficient arc drive to drive the lamp).

Those skilled in the art will appreciate that the excitation of the gas within the lamp causes the gas atoms to be excited to a higher energy state, such that the gas atoms liberate a photon as the gas atoms return to a lower energy state. The photons emitted by these gas atoms collide with phosphorous atoms within the phosphorous layer inside the lamp, causing the phosphorous atoms to liberate photons in the visible spectrum. The phosphorous atoms release these photons in the visible light spectrum which illuminates the screen display. Those skilled in the art will also appreciate that the luminescence of the phosphorous layer degrades over time, causing unnecessary power consumption and shorter lamp life. By minimizing degradation of the phosphorous layer, power consumption may be reduced, whereas battery life and lamp life may be extended. In accordance with a preferred aspect of the present invention, optimally efficient use of the lamp promotes lower power consumption, decreased phosphorous degradation, and extended lamp life.

With continued reference to FIG. 3, primary controller 304 suitably applies an appropriate lamp arc drive signal $V_d$ to the lamp, causing lamp 330 to emit light. Sensor 336 detects the brightness of the emitted light and generates a brightness feedback signal 338 which is equal to the desired brightness level established by the set-point value $V_{sp}$. In accordance with a preferred embodiment of the invention, secondary controller 314 is superimposed on the primary control scheme in a manner which allows the lamp to produce the desired brightness level at a minimum arc drive level. In accordance with one preferred embodiment of the present invention, this may be achieved by operating the lamp at an optimum temperature for a given set-point $V_{sp}$ value. The secondary control scheme described in relation to this preferred embodiment uses temperature as the controller parameter. It will be appreciated, however, that the present invention may be employed using other convenient control parameters to fine tune lamp brightness control. Other control parameters may be employed in the context of the present invention including, for example: the pressure within the lamp, the volume within the lamp, the amount of gas within the lamp, or any one or more of the foregoing alone or in conjunction with control of the arc drive frequency, voltage, or current through the gas.

With continued reference to FIG. 3, secondary controller 314 suitably applies a control signal 326 (also referred to herein as $V_T$) to heater wire 334. Changing the temperature in the lamp changes the amount of gas (e.g., mercury) that is in the vapor phase. In this way, secondary controller 314 suitably controls the temperature of the lamp, to thereby achieve the optimum operating temperature of the lamp to achieve a desired brightness level as determined by brightness set-point $V_{sp}$.

The operation of the secondary controller 314 in accordance with a preferred embodiment of the invention will now be described. A primary controller 304 adjusts $V_c$ such that the detected brightness level ($V_{fb}$) is equal to the desired brightness level ($V_{sp}$). When an equilibrium is established, the output ($V_c$) of primary controller 304 is constant. This means that the desired brightness level is equal to the actual brightness level. However, it remains to be determined whether the desired output brightness level may be achieved at a lower arc drive. With the output of primary controller 304 constant, secondary controller 314 suitably "tweaks" the temperature of the gas within the lamp slightly upwardly or slightly downwardly to determine whether placing more or less gas in the vapor phase within the tube may result in more efficient operation of the lamp.

More particularly, for a constant output $V_c$ of primary controller 304, secondary controller 314 suitably increases the temperature of the lamp by increasing output signal $V_T$. By increasing the lamp temperature, the brightness of the lamp will either increase or decrease. If the brightness level increases, sensor or transducer 336 will detect this increase in the actual brightness level and, in response, primary controller 304 will drive its output $V_c$ lower until the detected brightness level (indicated by signal $V_{fb}$) equals the desired brightness level ($V_{sp}$). In this case, a slight increase in the temperature of the gas within the lamp results in achieving the desired brightness level at a lower arc drive, thereby conserving power and reducing degradation of the phosphorous layer within the lamp. Moreover, secondary controller 314 may suitably be configured to continue to increase the temperature as long as the increased temperature results in a higher output brightness level from the lamp. For example, when mercury is the gas within the lamp, it is usually preferred that the temperature of the lamp not increase beyond 75 degrees C. At the point at which further increases in lamp temperature no longer produce a higher brightness level that is output from the lamp (or, alternatively, until the actual brightness level produced by the lamp decreases), the secondary controller 314 either stops increasing the lamp temperature or begins to reduce the lamp temperature.

Under certain operating conditions, it may be desirable to reduce the temperature of the lamp and still achieve a brighter output level from the lamp for a given lamp arc drive, for example, if external or environmental factors (e.g., sunlight or other heat radiating equipment proximate to the screen display) heat the lamp. Thus, it may be desirable to vary the output of secondary controller 314 to alternately cycle the lamp temperature upwardly and downwardly to achieve optimum lamp performance. In accordance with a particularly preferred embodiment of the present invention, a "dither" algorithm may be employed whereby lamp temperature is cycled upwardly until the brightness level produced by the lamp falls off, whereupon the temperature of the lamp is cycled downwardly until lamp output brightness level falls off, and so on. It will be appreciated that virtually any type of control scheme, including linear variations, non-linear variations, or variations which are a function of multiple parameters may be employed to control the temperature (or other control parameter) which is controlled by secondary controller 314.

More particularly, secondary controller 314 may suitably be configured to execute various modified control algorithms depending on such parameters as, for example, the brightness set-point value (shown as input 310 to secondary controller 314), the actual temperature of the lamp (for example as sensed by thermistor 328 and provided as an input 322 to secondary controller 314), and/or as a function of the voltage or frequency value of input signal 324 indicative of lamp temperature. Moreover, although secondary controller 314 has been described as functioning when signal $V_c$ is constant, the secondary controller may suitably operate even as the output from the primary controller 304 (namely, output $V_c$), is varying.

In accordance with a further aspect of the present invention, secondary controller 314 may be disabled when the brightness set-point value $V_{sp}$ is changing. Alternatively, inasmuch as secondary controller 314 is a relatively low authority or long-term controller, it may be desirable to simply allow secondary controller 314 to continue its fine tuning control function even as brightness set-point signal $V_{sp}$ is varied.

Figure 4:
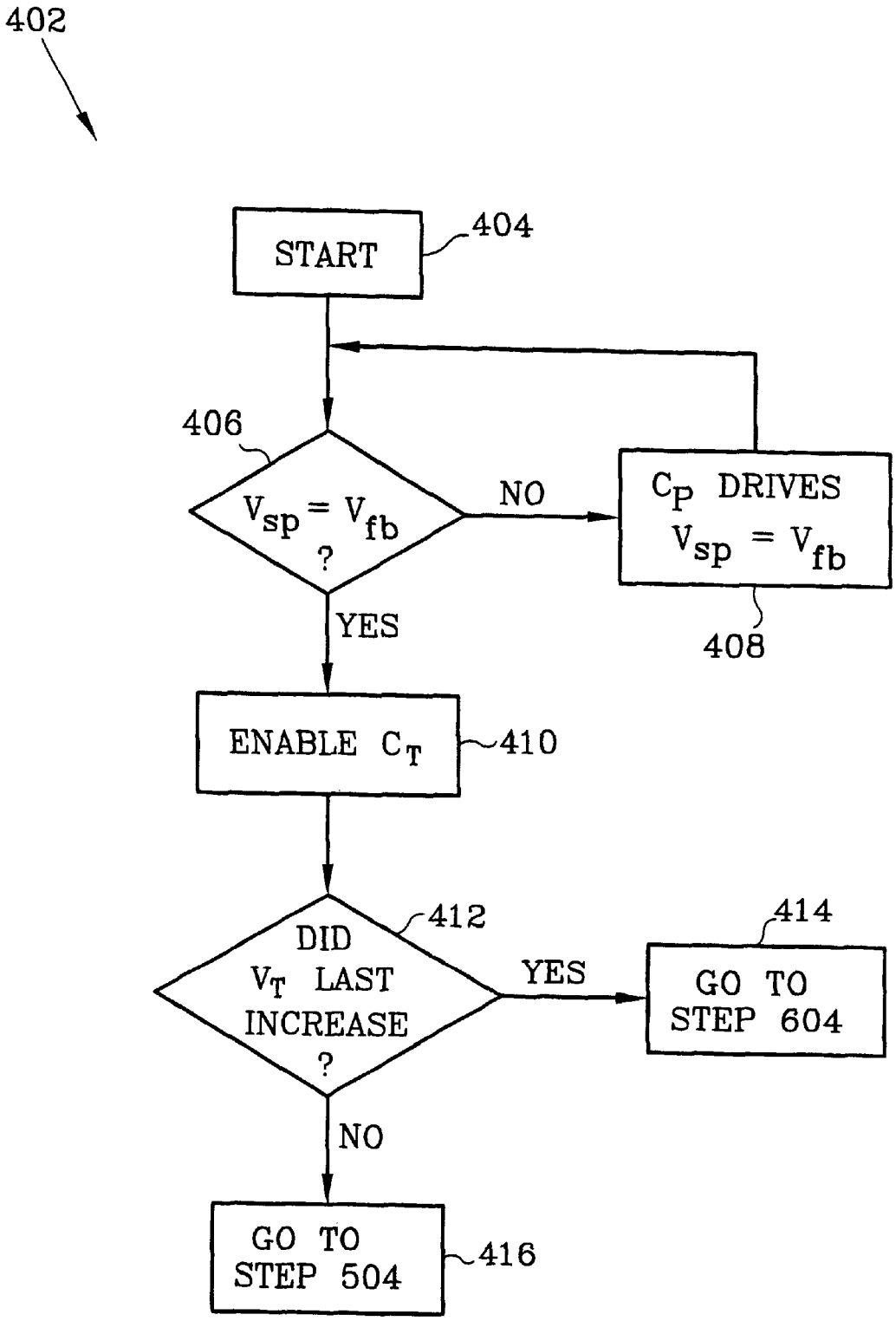
FIG. 4 is an exemplary flowchart diagram setting forth the operation of the primary and secondary controllers in accordance with a preferred embodiment of the present invention.
Figure 5:
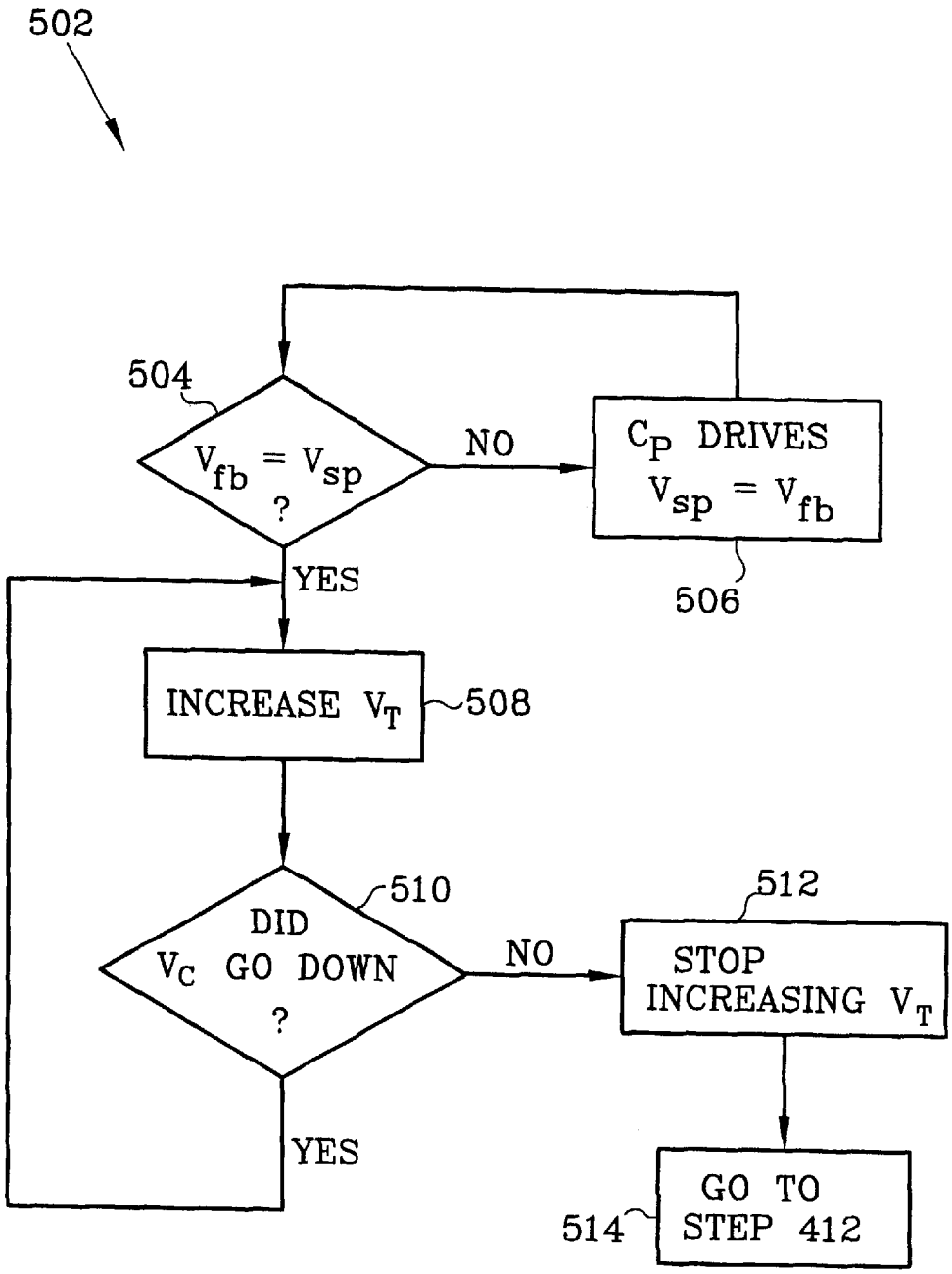
FIG. 5 is an exemplary flowchart diagram of various steps associated with increasing a control parameter under the control of the secondary controller.
Figure 6:
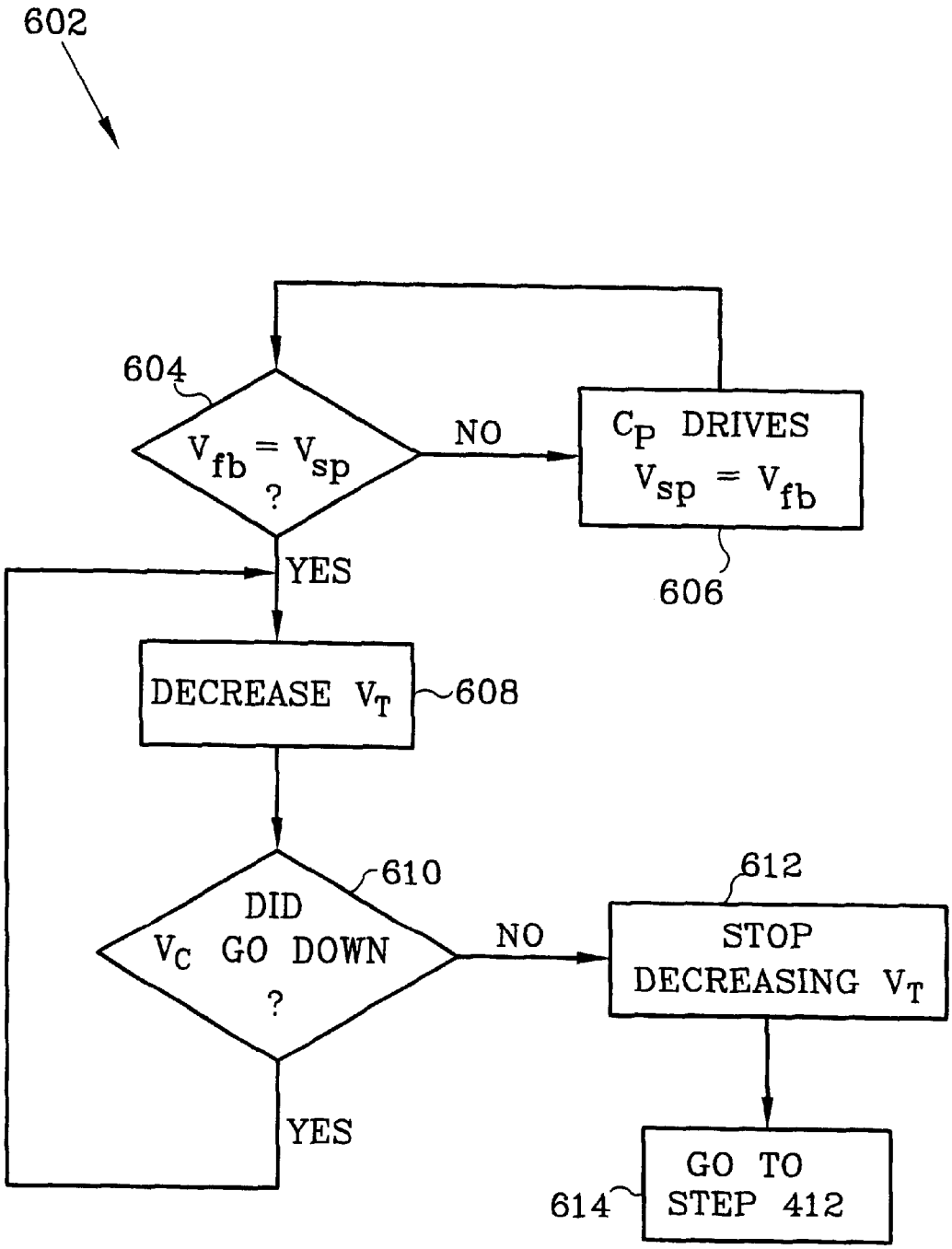
FIG. 6 is an exemplary flowchart diagram of various steps involved in decreasing a control parameter under the control of a secondary controller.

Referring now to FIGS. 4–6, the logical operation of control system 302 will now be described. With particular reference to FIG. 4 which depicts a flow chart 402, controller operation may suitably begin when the screen display is turned on, or when the lamp reaches a certain desired threshold temperature (step 404). With continued reference to FIG. 4 and with momentary reference to FIG. 3, the actual brightness level of the lamp 330 is compared to the desired brightness level (step 406). If the actual brightness level from the lamp ($V_{fb}$) is not equal to the desired brightness level ($V_{sp}$) ("no" branch from step 406), primary controller 304 will adjust its output $V_c$ until the actual brightness level equals the desired brightness level (step 408).

When the actual brightness level from the lamp is equal to the desired brightness level ("yes" branch from step 406), the secondary controller $C_T$ may be enabled (step 410). Or, as discussed above, the secondary controller $C_T$ may be allowed to operate even as the primary controller $C_p$ controls the arc drive. Secondary controller $C_T$ then determines, in accordance with its own internal control algorithm, whether the lamp temperature should be increased or decreased (step 412). In accordance with the illustrated embodiment, if the output signal $V_T$ was increased (i.e., the temperature was increased) during the last operational cycle of the secondary controller $C_T$ ("yes" branch from step 412), then the "decreased temperature" algorithm set forth in FIG. 6 may be performed. If, on the other hand, the output signal $V_T$ was last decreased ("no" branch from step 412), then an "increase temperature" algorithm may suitably be employed (step 416).

More particularly in referring now to FIGS. 3 and 5, secondary controller $C_T$ suitably determines whether $V_c$ is constant, i.e., whether the actual brightness signal detected from the lamp is equal to the desired brightness level (step 504). If the actual brightness level of the lamp is not equal to the desired brightness level ("no" branch from step 504), then the primary controller $C_p$ is employed to drive the actual brightness of the lamp equal to the desired brightness level (step 506).

If, on the other hand, the desired brightness level from the lamp equals the actual brightness level from the lamp ("yes" branch from step 504), secondary controller $C_T$ will slightly increase the temperature within the lamp to determine if the desired brightness level may be achieved at a lower arc drive (step 508). Upon increasing the temperature of the lamp, the actual brightness level of the lamp will either increase or decrease. For a given set-point value, if the actual brightness level of the lamp increases as lamp temperature increases, the output signal $V_c$ from primary controller 304 will be reduced ("yes" branch from step 510), resulting in more efficient operation of the lamp while maintaining the desired output brightness level. The system then continues to increase the temperature of the lamp in accordance with any suitable control algorithm (step 508) to determine if yet even more efficient lamp operation is achievable. It will be appreciated that although FIG. 5 implies that the brightness feedback signal $V_{fb}$ will be equal to the brightness set-point signal $V_{sp}$ ("yes" branch from step 504), there may be small deviations or variations within this control scheme. Furthermore, when the output signal $V_c$ goes down ("yes" branch from step 510) and the system continues to increase the output signal $V_T$, it will be appreciated that again there may be small deviations or variations within this control scheme. If further increase in lamp temperature results in a lower detected lamp brightness level, primary controller 304 will increase the arc drive to maintain the desired brightness level (corresponding to the "no" branch from step 510). At this point, the secondary controller $C_T$ will stop increasing temperature (step 512), inasmuch as the secondary controller $C_T$ has determined that any further increase in temperature will not result in a further improvement in lamp operating efficiency. The system then goes to step 514 which directs the system to go to step 412 (FIG. 4) to determine whether the lamp temperature should be increased or decreased, accordingly.

With momentary reference to FIG. 4, when it is determined that the last operational cycle of events described immediately above of the secondary controller $C_T$ involved an increase in lamp temperature which did not result in increased lamp operating efficiency ("yes" branch from step 412), it may be desirable to decrease lamp temperature in the next operational cycle of the secondary controller $C_T$ to determine whether a slightly lower lamp operating temperature may result in increased lamp operating efficiency (step 414 of FIG. 4). Otherwise, it may be desirable to increase lamp temperature in the next operational cycle of the secondary controller $C_T$ to determine whether a slightly higher lamp operating temperature may result in increased lamp operating efficiency (step 416 of FIG. 4).

Referring now to FIG. 6, if the actual brightness level is not equal to the desired brightness level (the "no" branch from step 604), the primary controller $C_p$ will change the arc drive to a point where the detected brightness level equals the desired brightness level of the lamp (step 606). In accordance with the illustrated embodiment, once the desired brightness level has been achieved ("yes" branch from step 604), the secondary controller $C_T$ may attempt to decrease lamp temperature to determine whether further operating efficiency may be achieved (step 608). If a decrease in temperature results in an increased detected brightness from the lamp, the primary controller $C_p$ will reduce the arc drive to maintain an actual brightness level produced by the lamp which is equal to the desired brightness level ("yes" branch from step 610). In the preferred exemplary embodiment, the secondary controller $C_T$ will again increase the lamp temperature slightly for so long as further operational efficiencies are obtained. It will be appreciated that although FIG. 6 implies that the brightness feedback signal $V_{fb}$ will be equal to the brightness set-point signal $V_{sp}$ ("yes" branch from step 604), there may be small deviations or variations within this control scheme. Furthermore, when the output signal $V_c$ goes down ("yes" branch from step 610) and the system continues to decrease the output signal $V_T$, it will be appreciated that again there may be small deviations or variations within this control scheme. Once the system reaches the point where further decreases in lamp temperature do not result in an increased brightness level from the lamp, the ("no" branch from step 610), the secondary controller $C_T$ suitably stops decreasing lamp temperature (step 612). The system then goes to step 614 which directs the system to go to step 412 (FIG. 4) to determine whether the lamp temperature should be increased or decreased, accordingly.

Figure 7:
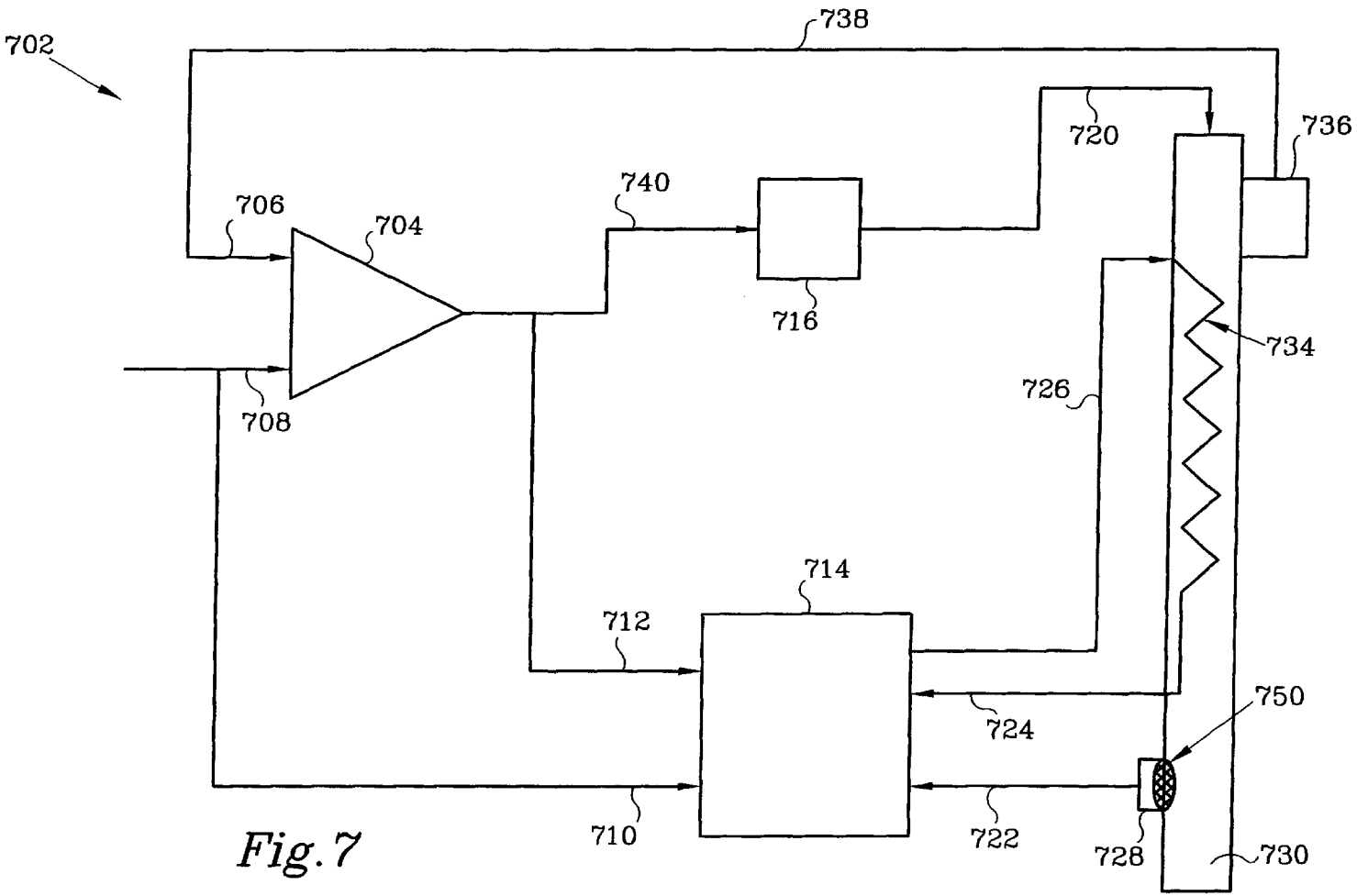
FIG. 7 is a schematic diagram illustrating an alternate embodiment of the invention, including the primary and secondary controllers of the present invention in conjunction with a cold spot or cold spot controller.

Referring now to FIG. 7, in which an exemplary lamp control circuit 702 illustrates a further embodiment of the invention. An exemplary lamp control circuit 702 suitably includes a lamp 730, a lamp heater 734 (e.g., a resistive wire), a sensor or transducer 736 (e.g., a photodiode), a first controller 704, a second controller 714, a gain stage 716, and a cold spot or cold spot controller 750. In the context of this description, the elements in FIG. 7 are analogous to the elements in FIG. 3, with the exception of cold spot or cold spot controller 750.

With continued reference to FIG. 7 and with momentary reference to FIGS. 3–6, this embodiment of the invention may be employed both without a fixed cold spot or in conjunction with a fixed cold spot. Cold spot or cold spot controller 750 (e.g., a copper cold shoe) may be employed with the present invention using virtually any known cold spot control techniques, including the invention disclosed herein. The cold spot controller 750 may be a thermoelectric cooler (TEC), a thermoelectric control mechanism (TCM), or any other known cold spot control mechanism.

Although the subject application has been described herein with reference to the appended drawing figures, it will be appreciated that the scope of the invention is not so limited. Various modifications in the design and implementation of various components and method steps discussed herein may be made without departing from the spirit and scope of the invention, as set forth in the appended claims.

What is claimed is:

1. An apparatus for controlling a first parameter of a lamp, comprising:

a sensor configured to detect the first parameter of the lamp and to generate a feedback signal which is indicative of the first parameter;

a primary controller having a first input to receive said feedback signal, and an output to provide an output signal to control a drive signal applied to the lamp; and a secondary controller having a second input to receive said output signal, and a second output configured to apply a second output signal to control a second parameter associated with the lamp.

2. A method for controlling a first parameter of a lamp, comprising the steps of:

sensing the first parameter of the lamp and generating a feedback signal which is indicative of the first parameter;

applying said feedback signal to a primary controller;

outputting from said primary controller an output signal to control a drive signal applied to the lamp;

providing a secondary controller responsive to said output signal; and controlling a second parameter associated with the lamp by applying a second output signal generated by said secondary controller to the lamp.

3. The apparatus of claim 1 wherein the first parameter comprises the brightness level of the lamp.

4. The apparatus of claim 1 wherein said primary controller is configured to adjust said drive signal to control the first parameter in accordance with a set-point signal.

5. The apparatus of claim 1 wherein said second parameter relates to the temperature associated with the lamp.

6. The apparatus of claim 1 wherein said second parameter relates to the pressure within the lamp.

7. The apparatus of claim 1 wherein said second parameter relates to the volume within the lamp.

8. The apparatus of claim 1 wherein said second parameter relates to the amount of gas within the lamp.

9. An apparatus for controlling a first parameter of a lamp, comprising:

a sensor configured to detect the first parameter of the lamp and to generate a feedback signal which is indicative of the first parameter, wherein said sensor comprises a photodiode;

a primary controller having a first input to receive said feedback signal, and an output to provide an output signal to control a drive signal applied to the lamp, wherein said primary controller comprises an error control amplifier with a gain stage; and a secondary controller having a second input to receive said output signal, and a second output configured to apply a second output signal to control a second parameter associated with the lamp, wherein said secondary controller employs a dithering algorithm to control at least one of temperature, pressure, volume, and the amount of gas within the lamp.

10. The apparatus of claim 1 further comprising a cold spot including a copper cold shoe associated with the lamp.

11. The apparatus of claim 1 further comprising a cold spot controller associated with the lamp.

12. The apparatus of claim 11 wherein said cold spot controller comprises a thermo-electric cooler (TEC).

13. The apparatus of claim 11 wherein said cold spot controller comprises a thermo-electric control mechanism (TCM).

14. The method of claim 2 wherein the step of sensing the first parameter of the lamp comprises sensing a brightness level of the lamp with a photodiode.

15. The method of claim 2 wherein the step of applying said feedback signal to said primary controller comprises applying said feedback signal to a first input of an error control amplifier.

16. The method of claim 2 further comprising amplifying said output signal from said primary controller with a gain stage.

17. The method of claim 2 wherein the step of applying said feedback signal to said primary controller further comprises applying a set-point signal to said primary controller.

18. A method for controlling a first parameter of a lamp comprising the steps of:

sensing the first parameter of the lamp and generating a feedback signal which is indicative of the first parameter;

applying said feedback signal to a primary controller;

outputting from said primary controller an output signal to control a drive signal applied to the lamp;

providing a secondary controller responsive to said output signal; and controlling a second parameter associated with the lamp by applying a second output signal generated by said secondary controller to the lamp, wherein said secondary controller is configured to employ a dithering algorithm.

19. The method of claim 2 wherein the step of controlling said second parameter associated with the lamp includes:

controlling at least one of the temperature, pressure, volume, and amount of gas within the lamp; and applying said second output signal generated by said secondary controller to a resistive wire positioned for thermal interaction with the lamp.

20. A liquid crystal display (LCD) comprising:

an LCD configured to display data;

a lamp positioned to provide back illumination for the LCD;

a sensor configured to detect a first parameter of said lamp and to generate a feedback signal which is indicative of said first parameter;

a primary controller having a first input to receive said feedback signal, and an output to provide an output signal to control a drive signal applied to said lamp; and a secondary controller having a second input to receive said output signal, and a second output configured to generate a second output signal to control a second parameter associated with said lamp.

* * * * *